US010765152B2

(12) United States Patent
Gadson

(10) Patent No.: US 10,765,152 B2
(45) Date of Patent: Sep. 8, 2020

(54) GARMENT CUFF PROTECTION DEVICE

(71) Applicant: Wilbur Gadson, Gadsden, AL (US)

(72) Inventor: Wilbur Gadson, Gadsden, AL (US)

( * ) Notice: Subject to any disclaimer, the term of this patent is extended or adjusted under 35 U.S.C. 154(b) by 0 days.

(21) Appl. No.: 16/124,260

(22) Filed: Sep. 7, 2018

(65) Prior Publication Data

US 2020/0077716 A1 Mar. 12, 2020

(51) Int. Cl.
*A41B 7/12* (2006.01)
*A41B 1/00* (2006.01)

(52) U.S. Cl.
CPC ..... *A41B 7/12* (2013.01); *A41B 1/00* (2013.01); *A41B 2300/328* (2013.01)

(58) Field of Classification Search
CPC ..... A41B 3/18; A41B 7/12
See application file for complete search history.

(56) References Cited

U.S. PATENT DOCUMENTS

| | | | | |
|---|---|---|---|---|
| 1,013,126 | A | 1/1912 | Cerri | |
| 1,433,198 | A | 10/1922 | Gemmill | |
| 2,042,567 | A | 6/1936 | Trieschmann | |
| 2,823,386 | A * | 2/1958 | Loaiza | A41B 7/12 2/46 |
| 3,088,117 | A | 5/1963 | Baker | |
| 4,014,046 | A | 3/1977 | Craig | |
| 5,575,410 | A | 11/1996 | Compton | |
| D750,352 | S | 3/2016 | Szalay | |
| 2015/0007373 | A1* | 1/2015 | Martin | A41B 3/18 2/60 |

* cited by examiner

*Primary Examiner* — Tajash D Patel

(57) ABSTRACT

A garment cuff protection device for preventing soiling of cuffs includes a panel that is flexible. A coupler is coupled to a first face of the panel and is configured to removably couple the panel to an interior surface of a cuff of a sleeve of a garment. The panel is configured to prevent soiling of the cuff.

8 Claims, 3 Drawing Sheets

GARMENT CUFF PROTECTION DEVICE

CROSS-REFERENCE TO RELATED APPLICATIONS

Not Applicable.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to garment accessories and more particularly pertains to a new garment accessory for preventing soiling of cuffs.

BRIEF SUMMARY OF THE INVENTION

An embodiment of the disclosure meets the needs presented above by generally comprising a panel that is flexible. A coupler is coupled to a first face of the panel and is configured to removably couple the panel to an interior surface of a cuff of a sleeve of a garment. The panel is configured to prevent soiling of the cuff.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
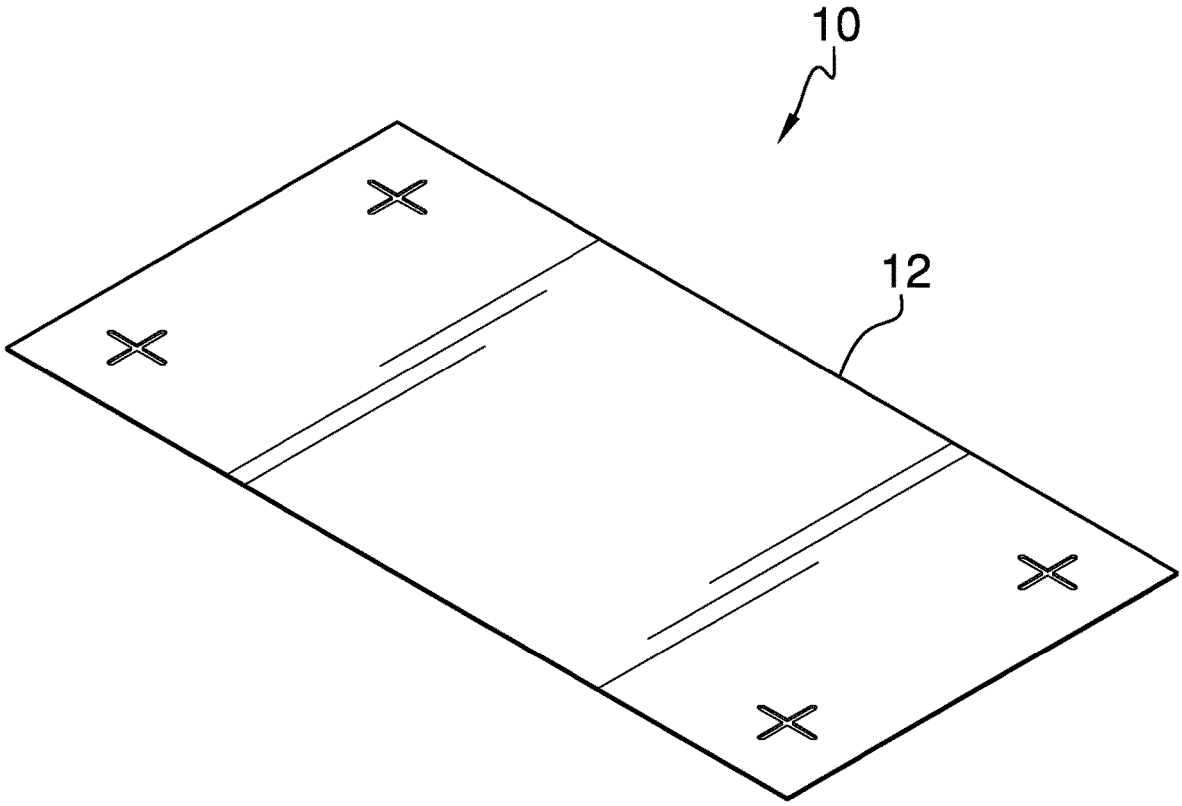
FIG. 1 is an isometric perspective view of a garment cuff protection device according to an embodiment of the disclosure.

With reference now to the drawings, and in particular to FIGS. 1 through 4 thereof, a new garment accessory embodying the principles and concepts of an embodiment of the disclosure and generally designated by the reference numeral 10 will be described.

As best illustrated in FIGS. 1 through 4, the garment cuff protection device 10 generally comprises a panel 12 that is flexible. The panel 12 is substantially rectangularly shaped, as shown in FIG. 1. The panel 12 comprises fabric, cotton, cotton-polyester blend, or the like.

Figure 4:
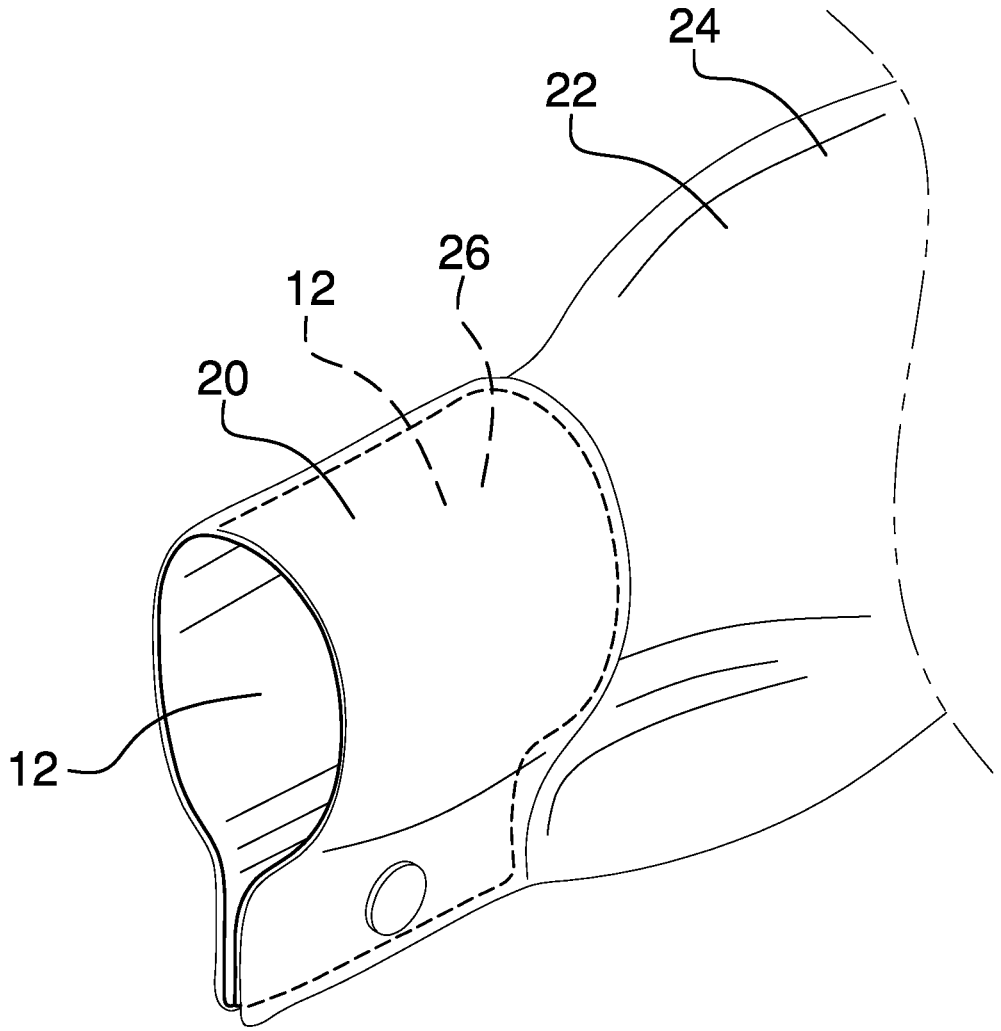
FIG. 4 is an in-use view of an embodiment of the disclosure.

A coupler 14 is coupled to a first face 16 of the panel 12. The coupler 14 is configured to removably couple the panel 12 to an interior surface 18 of a cuff 20 of a sleeve 22 of a garment 24, as shown in FIG. 4. The panel 12 is configured to prevent soiling of the cuff 20, as can occur when the cuff 20 contacts skin and jewelry. The panel 12 prevents oil and sweat from transferring from the skin and the jewelry, such as a watch and a bracelet, to the cuff 20. The panel 12 has the potential to decrease the required frequency of laundering or dry cleaning of the garment 24. The present invention is anticipated to be particularly useful with a garment 24 having cuffs 20 that are French style.

The present invention anticipates the panel 12 being colored or patterned to match or complement to the cuff 20.

Figure 2:
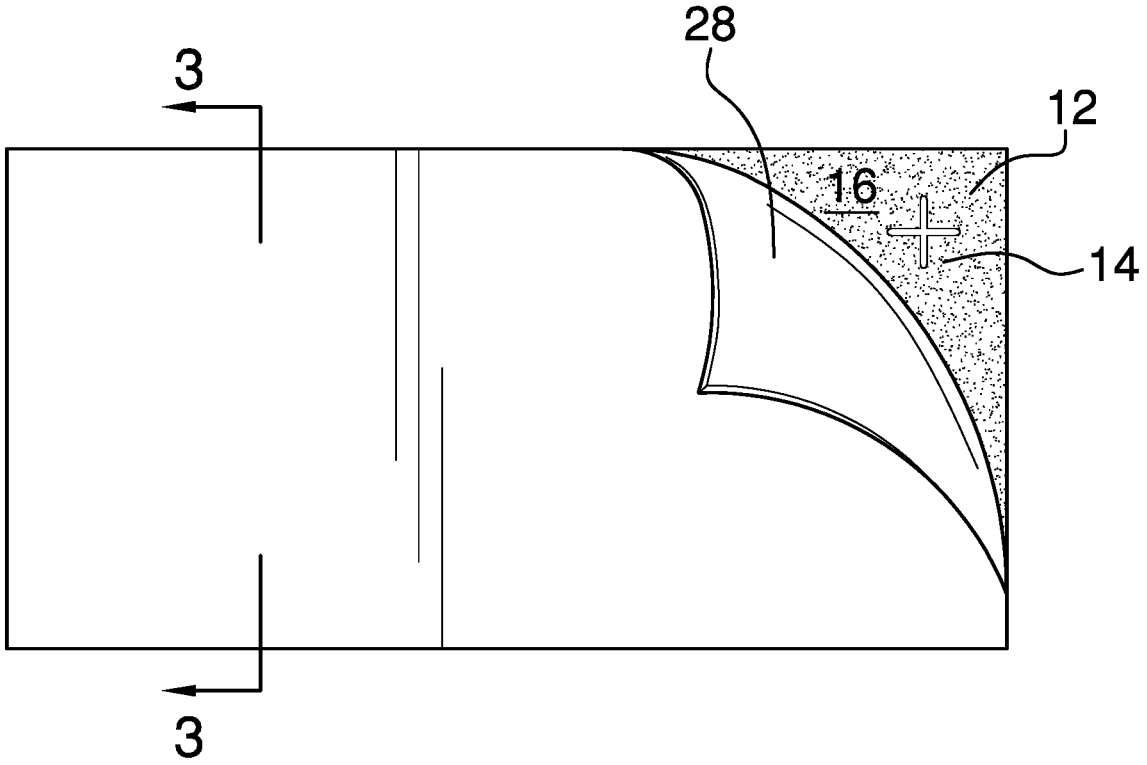
FIG. 2 is a bottom view of an embodiment of the disclosure.
Figure 3:
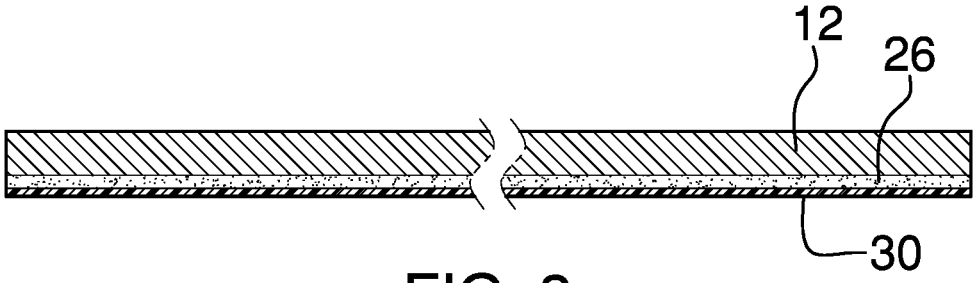
FIG. 3 is a cross-sectional view of an embodiment of the disclosure.

The coupler 14 comprises an adhesive 26, as shown in FIG. 2. A sheet 28, which comprises wax-coated paper 30, is removably coupled to the adhesive 26, as shown in FIG. 2. The sheet 28 is configured to be separated from the adhesive 26 to expose the adhesive 26. The adhesive 26 is configured to couple to the interior surface 18 of the cuff 20 to removably couple the panel 12 to the cuff 20, as shown in FIG. 4.

In use, the sheet 28 is removed from the adhesive 26 so that the adhesive 26 is configured to couple to the interior surface 18 of the cuff 20 to removably couple the panel 12 to the cuff 20. The panel 12 is configured to prevent soiling of the cuff 20, as can occur when the cuff 20 contacts skin and jewelry.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A garment cuff protection device combination comprising:

a garment having a sleeve ending in a cuff;

a panel, the panel being flexible, the panel having opposed lateral edges; and a coupler coupled to a first face of the panel, the coupler removably coupling the panel to an interior surface of the cuff of the sleeve of the garment with the opposed lateral edges of the panel extending perpendicularly away from a distal edge of the cuff relative to the sleeve, the panel being rectangular and each opposed lateral edge having a length such that the panel covers a full extent of the interior surface of the cuff between the opposed lateral edge from the distal edge of the cuff to the sleeve wherein the panel is configured for preventing soiling of the interior surface of the cuff covered by the panel.

2. The device of claim 1, further including the panel comprising fabric.

3. The device of claim 2, further including the panel comprising cotton.

4. The device of claim 3, further including the panel comprising cotton-polyester blend.

5. The device of claim 1, further including the coupler comprising an adhesive.

6. The device of claim 5, further including a sheet removably coupled to the adhesive wherein the sheet is configured for separating from the adhesive for exposing the adhesive wherein the adhesive is configured for coupling to the interior surface of the cuff for removably coupling the panel to the cuff.

7. The device of claim 6, further including the sheet comprising wax-coated paper.

8. A garment cuff protection combination device comprising:

a garment having a sleeve ending in a cuff;

a panel, the panel being flexible, the panel being substantially rectangularly shaped, the panel comprising fabric, the panel comprising cotton, the panel comprising cotton-polyester blend;

a coupler coupled to a first face of the panel the coupler removably coupling the panel to the cuff of the sleeve of the garment with the opposed lateral edges of the panel extending perpendicularly away from a distal edge of the cuff relative to the sleeve, the panel being rectangular and each opposed lateral edge having a length such that the panel covers a full extent of the interior surface of the cuff between the opposed lateral edge from the distal edge of the cuff to the sleeve wherein the panel is configured for preventing soiling of the interior surface of the cuff covered by the panel, the coupler comprising an adhesive; and a sheet removably coupled to the adhesive wherein the sheet is configured for separating from the adhesive for exposing the adhesive wherein the adhesive is configured for coupling to the interior surface of the cuff for removably coupling the panel to the cuff, the sheet comprising wax-coated paper.

* * * * *